US005235126A

United States Patent [19]

Bruti et al.

[11] Patent Number: 5,235,126

[45] Date of Patent: Aug. 10, 1993

[54] CHORD DETECTING DEVICE IN AN AUTOMATIC ACCOMPANIMENT-PLAYING APPARATUS

[75] Inventors: Luigi Bruti, Pedaso; Demetrio Cuccu', Fermo; Nicola Calo', San Benedetto del Tronto, all of Italy

[73] Assignee: Roland Europe S.p.A., Teramo, Italy

[21] Appl. No.: 837,903

[22] Filed: Feb. 20, 1992

[30] Foreign Application Priority Data

Feb. 25, 1991 [IT] Italy ..... MI91A000471

[51] Int. Cl.[5] ..... G10H 1/22; G10H 1/38; G10H 7/00

[52] U.S. Cl. ..... 84/618; 84/637; 84/669; 84/DIG. 2; 84/DIG. 22

[58] Field of Search ..... 84/613, 618, 637, 650–652, 84/656, 669, 684, 715, DIG. 2, DIG. 22

[56] References Cited

U.S. PATENT DOCUMENTS 4,489,636 12/1984 Aoki et al. ..... 84/DIG. 22

*Primary Examiner*—Stanley J. Witkowski

*Attorney, Agent, or Firm*—Keck, Mahin & Cate

[57] ABSTRACT

In an automatic accompaniment-playing apparatus, when an accompaniment pattern corresponding to a detected chord is not stored as information in a memory, an accompaniment pattern as information read from the memory in accordance with the priority level is changed so as to be suited to the detected chord. In a chord detecting apparatus, inversion modes are obtained based on an information-on-depressed-key so as to determine chords relative to the inversion modes obtained in this way. Then, the chords determined in this way are weighted, and a chord weighted at the maximum level out of the chords thus weighted is determined as one based on the above information-on-depressed-key.

6 Claims, 5 Drawing Sheets

| CT | WORKING AREA |
|---|---|
| 0 | 36 |
| 1 | 40 |
| 2 | 43 |
| 3 | 45 |
| ⋮ | |
| n | |

| BIT PATTERNS | | | | | | | | | | | | TYPES OF CHORDS |
|---|---|---|---|---|---|---|---|---|---|---|---|---|
| 0 | 1 | 2 | 3 | 4 | 5 | 6 | 7 | 8 | 9 | 10 | 11 | |
| 1 | | | 1 | | | 1 | | | | | | dim |
| 1 | | | | | | 1 | | | 1 | | | |
| 1 | | | 1 | | | | | | 1 | | | |
| 1 | | | 1 | | | 1 | | | | 1 | | |
| 1 | | | 1 | | | 1 | | | 1 | | | |
| 1 | | | | 1 | | | 1 | | | | | maj |
| 1 | | | 1 | | | | | | | | | min |
| 1 | | | | | | 0 | 0 | 1 | | | | aug |
| 1 | | | | | | | | | | 0 | 1 | maj 7th |
| 1 | | | | | | | | | | 1 | | 7th |
| 1 | | | | | | | | | 1 | | | 6th |
| ⋮ | ⋮ | ⋮ | ⋮ | ⋮ | ⋮ | ⋮ | ⋮ | ⋮ | ⋮ | ⋮ | ⋮ | ⋮ |

FIG. 6

| TYPES OF CHORDS | WEIGHT FACTORS |
|---|---|
| maj | 13 |
| min | 12 |
| 7th | 10 |
| maj 7th | 9 |
| 6th | 3 |
| aug | 2 |
| ⋮ | ⋮ |

FIG. 7

| TYPES OF CHORDS | PRIORITY LEVEL | | | | |
|---|---|---|---|---|---|
| | maj | min | 7th | maj 7th | min 7th |
| maj | 1 | 2 | 3 | 4 | 5 |
| min | 2 | 1 | 4 | 5 | 3 |
| 7 th | 4 | 5 | 1 | 2 | 3 |
| maj 7th | 3 | 5 | 4 | 1 | 2 |
| min 7th | 4 | 3 | 2 | 5 | 1 |
| 9 th | 2 | 5 | 1 | 3 | 4 |
| ⋮ | ⋮ | ⋮ | ⋮ | ⋮ | ⋮ |

FIG. 8

CHORD DETECTING DEVICE IN AN AUTOMATIC ACCOMPANIMENT-PLAYING APPARATUS

BACKGROUND OF THE INVENTION

1) Field of the Invention

The present invention relates to a chord detecting device for detecting chords based on information-on-depressed-key obtained at the time that a plurality of keys on a keyboard provided in an electronic musical instrument such as an electronic organ, etc. are depressed, and to an automatic accompaniment-playing apparatus for automatically selecting a desired accompaniment pattern based on a detected chord so as to perform an accompaniment based on the thus-selected accompaniment pattern.

2) Description of the Related Prior Art

A chord detecting apparatus, has heretofore been known in which a designated musical-sound pattern, a pattern-on-depressed-key, etc. is associated with each chord in a 1:1 correspondence to be stored as information in a memory, thereby detecting a desired chord on the basis of the musical-sound pattern, referring to a correspondence table obtained on their relative connection referred to above.

As a method of detecting a desired chord to determine an accompaniment pattern corresponding to the detected chord, there is known one in which each of a number of accompaniment patterns is associated with each of a number of chords in a 1:1 correspondence to be stored as information in a memory, thereby reading or selecting a desired accompaniment pattern corresponding to the detected chord from the memory.

When it is desired to adopt the method in which the pattern-on-depressed-key is associated with each chord in a 1:1 correspondence to detect a desired chord based on the information-on-depressed-key, so as to be stored as information in the memory, this method involves the problem that even when a depression key falls within one octave by way of example, it is necessary to perform a corresponding process of 2 to the twelfth power (4096), and a chord includes component sounds referred to as so-called "tension" (a ninth (9th) chord, an eleventh (11th) chord, a thirteenth (13th) chord, etc.) above one octave, thus resulting in the necessity of providing a large number of correspondence tables if they are included.

In addition, chords referred to as major seventh (maj7th) and minor seventh (min7th) chords are obtained by adding a seventh (7th) musical degree to a major (maj) chord and the same to a minor (min) chord, respectively, each of which comprises three pitch names. Furthermore, if a ninth (9th) musical degree is added to them, those referred to as major ninth (maj9th) and minor ninth (min9th) chords are obtained. Thus, the chords are defined by such combinations referred to above. It is then examined by means of this method whether or not these 7th and 9th are included in the three pitch names forming the chord of the major (maj) or the minor (min). As a consequence, a desired chord may be specified based on the result of its examination.

However, a problem arises in that when the plurality of keys are depressed, it is not clear which sound would be a root, and when keys of the 7th and 9th are also depressed, the chord cannot be specified unequivocally.

On the other hand, when it is desired to prepare an accompaniment pattern corresponding to the type of a chord for each performance mode such as rock, jazz, classics or for each performance section such as an introduction, an ending, normal, a variation, upon selection of an accompaniment pattern corresponding to a chord specified by some method, a mass-storage type memory is required. When the accompaniment pattern is established in such a manner that a performer can input the same, a burden on the process for inputting the same is increased, thereby causing a problem.

SUMMARY OF THE INVENTION

With the foregoing problems in view, it is an object of the present invention to provide a chord detecting apparatus capable of specifying broad chords including a seventh (7th) chord, a ninth (9th) chord, etc. based on designated musical-sound patterns without reference to the fact that a musical-sound pattern is associated with a chord in a 1:1 correspondence, and to provide an automatic accompaniment-playing apparatus capable of reducing the number of accompaniment patterns set in advance.

According to one aspect of the present invention, there is provided a chord detecting device comprising inversion mode arithmetic means for arithmetically determining respective inversion modes corresponding to chords when a plurality of pitch names corresponding to musical sounds to be performed are defined as chords; chord determining means for determining chords corresponding to the inversion modes respectively; weighting arithmetic means for providing the weight to the chords determined by the chord determining means; and chord detecting means for detecting a chord weighted in the maximum level out of the weighted chords as one corresponding to each of the plurality of pitch names.

As a method of determining the weight in the weighting arithmetic means, there is adopted, for example, one in which the weights are determined for every element indicative of the types of the chords determined by the chord determining means so as to add the thus-determined weights together, thereby obtaining the weight applied to the chords based on the result of its addition.

According to another aspect of the present invention, there is provided an automatic accompaniment playing apparatus comprising:

chord detecting means for detecting a chord comprising a plurality of pitch names corresponding to musical sounds to be performed;

accompaniment pattern storing means, for storing therein an accompaniment pattern corresponding at least one type of chord;

priority level storing means for storing therein information about the priority level of types of chords for each type of chord; and accompaniment pattern modifying means for reading an accompaniment pattern (corresponding to the type of any chord, which is given the highest priority, different from the types of chords, corresponding to the accompaniment patterns stored as information in the accompaniment pattern storing means) from the accompaniment pattern storing means, so that the accompaniment patterns, corresponding to the types of chord detected by the chord detecting means, are free from being stored in the accompaniment pattern storing means, thereby modifying the thus-read accompaniment pattern in such a manner that it is suited to the chord detected by the chord detecting means.

The accompaniment pattern storing means stores therein the accompaniment pattern as information corresponding to the type of at least one chord for each performance mode or for each performance section or for each combination of performance mode and section, for example. In addition, the priority-level storing means store therein the information about the priority level of the chordal types corresponding to the accompaniment patterns stored as information in the accompaniment pattern storing means.

In addition, the automatic accompaniment-playing apparatus may be provided with priority-level inputting means for inputting the priority level as information in the priority-level storing means.

According to the chord detecting device of the present invention, the chords corresponding to the inversion modes obtained by the inversion mode arithmetic means are determined. Then, the chords thus determined are weighted, and the chord weighted in the maximum level out of the chords thus weighted is determined as the chord obtained at the time of depression of a key. Therefore, a chord capable of entering into performer's intentions or feelings can be obtained even when the chord is not fixed unequivocally due to the fact that a seventh (7th) chord, a ninth (9th) chord and the like are included.

According to the automatic accompaniment-playing apparatus, when an accompaniment pattern corresponding to the type of a chord, which is detected based on information- on-depressed-key, is not stored in a memory, an accompaniment pattern corresponding to the type of chord, which is given the highest priority, out of the accompaniment patterns stored as information in the memory, is read. Then, the thus-read accompaniment pattern is changed so as to be fitted to the detected chord, thereby performing an accompaniment based on the thus-changed accompaniment pattern. It is therefore unnecessary to prepare accompaniment patterns for every performance mode such as rock, jazz, classics, etc., or for every performance section such as an introduction, an ending, a variation, and for every numbers of chords. As a consequence, the number of accompaniment patterns to be prepared can be reduced, and the capacity of the memory for storing therein the accompaniment patterns as information can be reduced correspondingly. In addition, a burden on the procedure for inputting the information about the accompaniment patterns can be lightened in an apparatus of the type wherein a performer can input the accompaniment patterns.

In addition, it is feasible to perform an accompaniment which approaches a performer's intention, even when the number of the accompaniment patterns is reduced, by providing the priority-level inputting means in such a manner that the performer can input the priority level as information.

According to the chord detecting device for an automatic playing apparatus, as has been described in detail, the inversion modes are obtained based on the information-on-depressed-key so as to determine chords relative to the so-obtained inversion modes. Then, the thus-determined chords are weighted, and a chord weighted in the maximum level out of the chords thus weighted is determined as one based on the above information-on-depressed-key. It is thus unnecessary to store information about chords in the memory in such a way that they are associated with all the patterns obtained by depressing keys. In addition, the capacity of the memory can be reduced.

According to the automatic accompaniment-playing apparatus, when the accompaniment pattern corresponding to the detected chord is not stored in the memory, the accompaniment pattern read from the memory in accordance with the priority level is changed so as to be fitted to the detected chord. Therefore, it is unnecessary to store the accompaniment patterns corresponding to all the chords in the memory. In addition, the capacity of the memory can be reduced and a burden on the procedure for inputting the information about the accompaniment pattern can be lightened.

The above and other objects, features and advantages of the present invention will become apparent from the following description and the appended claims, taken in conjunction with the accompanying drawings in which a preferred embodiment of the present invention is shown by way of illustrative example.

BRIEF DESCRIPTION OF THE DRAWINGS

FIG. 6 is a diagram showing a part of a correspondence table for causing chordal types to be associated with the difference among patterns at respective note numbers represented by the information-on-depressed-key obtained in accordance with the program shown in FIG. 5;

FIG. 7 is a diagram depicting a part of a weight factor table for illustrating the weight applied to the chordal types based on the correspondence table shown in FIG. 6; and FIG. 8 is a diagram showing a part of a priority-level table in which the order of priority is applied for every chordal type, the table being so produced that a set of a chordal type and a priority is associated with each of musical-performance patterns one by one.

DETAILED DESCRIPTION OF THE PREFERRED EMBODIMENTS

A preferred embodiment of the present invention will hereinafter be described with reference to the accompanying drawings.

Figure 1:
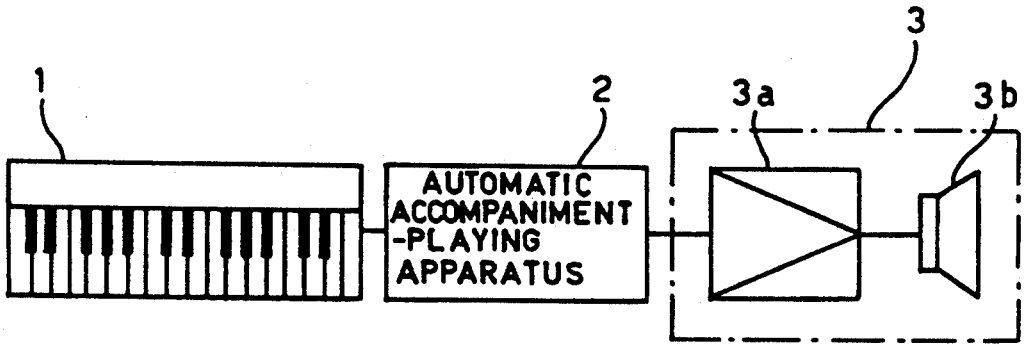
FIG. 1 is a schematic block diagram showing the manner in which a keyboard and a sound system are connected to an automatic accompaniment-playing apparatus with a chord detecting device included therein according to the present invention.

FIG. 1 is a schematic block diagram showing the manner in which a keyboard and a sound system are connected to an automatic accompaniment-playing apparatus with a chord detecting device included therein according to one embodiment of the present invention.

The automatic accompaniment-playing apparatus 2 is connected to a keyboard 1 by means of an interface referred to as "MIDI (Musical Instrument Digital Interface)" which is based on the digital interface standard used for electronic musical instruments. When respective keys on the keyboard 1 are depressed, information obtained by the depression of the keys is inputted to the automatic accompaniment-playing apparatus 2. The automatic accompaniment-playing apparatus 2 is one designed to automatically play an accompaniment, which is connected to a rhythm instrument carrying out a rhythm performance or the like based on the information-on- depressed-key. A musical acoustic sound as an electric signal produced by the automatic accompaniment-playing apparatus 2, is applied to a sound system 3 provided with an amplifier 3*a* and a speaker 3*b*, from which it is radiated into the air. Incidentally, a detailed description of the MIDI standard will now be omitted because the MIDI standard is already known (see Japanese Patent Application No. 59(1984)-129745, for example).

The automatic accompaniment-playing apparatus 2 has a computer system incorporated therein including an interface used to receive information-on-depressed-key based on the MIDI standard, a ROM used to store a program therein, a RAM used to store different types of data or the like, a CPU used to execute programs, etc. A program to be described later is to be executed by this computer system.

Figure 2:
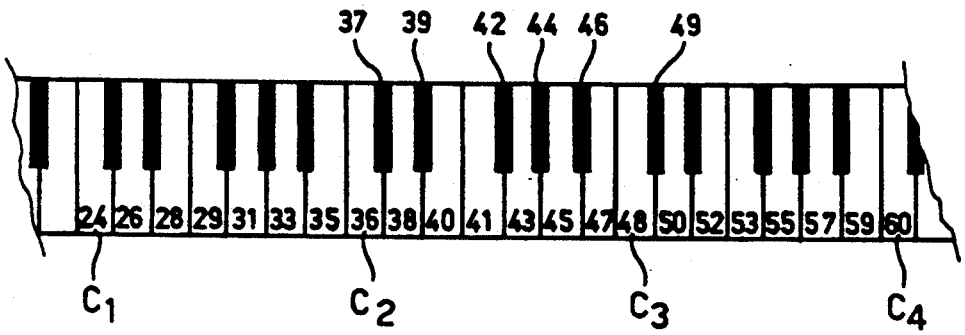
FIG. 2 is a diagram showing note numbers based on the MIDI standard, which are indicated on the keyboard.

FIG. 2 is a diagram showing note numbers based on the MIDI standard, which are represented on the keyboard.

As shown in FIG. 2, according to the MIDI standard, a center key $C_4$ of the keyboard is defined as number 60. Then, each number referred to as "Note Number", which increases one each time a sound or tone is sharped and which decreases one each time the tone is flatted, is assigned to each key.

Figures 3, 4:
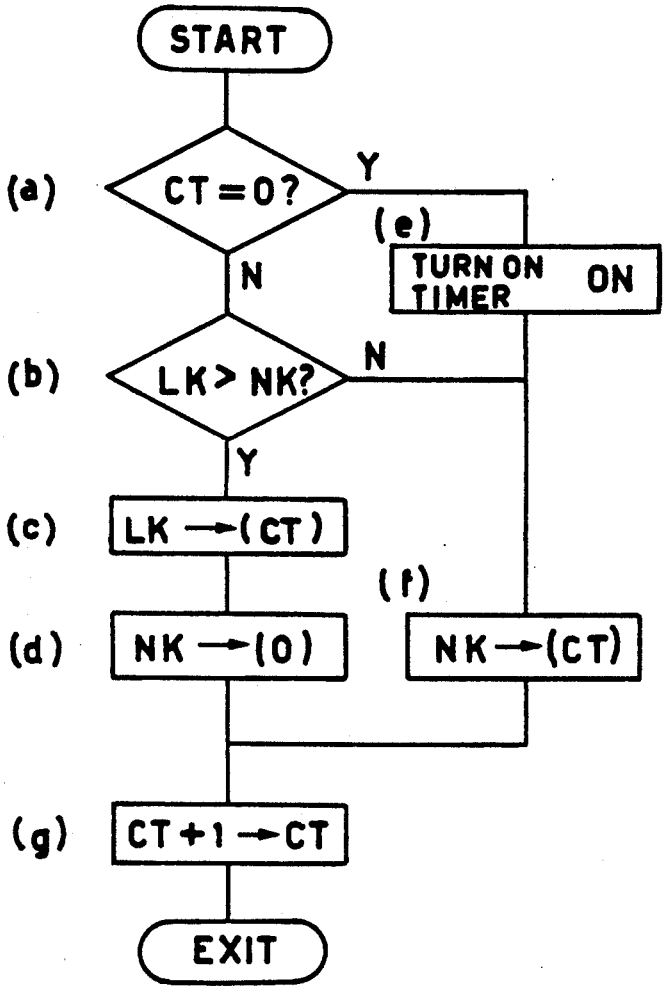
FIG. 3 is a flowchart for describing the procedure of a program executed upon receipt of information-on-depressed-key.
FIG. 4 is a diagram for describing a working area in RAM, which is used in the program shown in FIG. 3.

FIG. 3 is a flowchart for describing the procedure of a program executed upon receipt of information-on-depressed- key. Even when a plurality of keys are depressed simultaneously, programs corresponding to the number of keys depressed by an operator are executed.

FIG. 4 is a diagram showing a working area in a RAM, which is used for the program shown in FIG.3.

Let's here assume that a value CT indicative of an address in the working area is initiated into CT=0 indicative of a head address in the working area by means of an initial program executed upon turning on the power supply in the automatic accompaniment-playing apparatus 2, for example.

When a key of "Mi" at a note number 40 shown in FIG. 2 by way of example is depressed in such an initiated state, and information obtained by the depression of the key is inputted to the automatic accompaniment-playing apparatus 2 (see FIG. 1), the program shown in FIG. 3 is executed. It is first determined whether CT is equal to zero or not (CT=0 or CT≠0) (Step (a)). Since CT is placed on an initiated state, a judgment is made as being CT=0. The routine procedure proceeds to Step (e). Then, a timer for executing a program shown in FIG. 5 to be described later is turned on at the time of time-up thereof. Next, information about the note number 40 included in information-on depressed-key is recorded in a memory region indicative of an address 0 (CT=0) in the working areas in Step (f). Thereafter, the value of CT is incremented by 1 in Step (g), thereby bringing CT into one (CT=1). Here, an NK, which appears in the flowchart, represents a note number of a key depressed this time, whereas an LK shows a note number as information recorded in the memory region indicative of the address 0 in the working area.

Then, when a key of a note number 36 ("Do") is depressed simultaneously with the depression of the key of the note number 40 ("Mi") or with a slight delay from its depression, the program shown in FIG. 3 is executed again. As a consequence, CT becomes equal to 1 (CT=1) (CT≠0), and hence the routine procedure proceeds to Step (a) and thereafter to Step (b), followed by comparing the LK and NK. In this case, LK is equal to 40 (LK=40), and NK is equal to 36 (NK=36), and hence the routine procedure advances to Step (c). The information about LK=40, which has been recorded in the memory region indicative of the address 0 in the working area, is recorded in a memory region indicative of an address represented by CT (CT=1 in the present embodiment). In addition, the information about NK=36 instead of that about LK=40 is recorded in the memory region indicative of the address 0 (Step (d)), and thereafter the value of CT is incremented by 1 (Step (g)). When the program referred to above is repeatedly performed in this way, a note number applied to a key corresponding to the lowest sound, out of a plurality of keys depressed by the operator, is recorded in the memory region indicative of the address 0 in the working area.

Next, when a key of "Sol" at a note number 43 is further depressed, CT is set equal to 2 (CT=2) (CT≠=0). Therefore, the routine procedure proceeds to Step (b) after Step (a). At this time, LK=36 and NK=43 (LK<NK), and hence the routine procedure advances to Step (f). Thus, the information about NK=43 is stored in a memory region indicative of an address (CT=2) represented by CT in the working area. Thereafter, the value of CT is incremented by 1 in Step (g), and hence CT is set equal to 3 (CT=3). Then, when a key of "La" at a note number 45 is depressed in the same manner as described above, the information about NK=45 is stored in a memory region indicative of CT=3, and the value of CT is incremented by 1, so that CT is set equal to 4 (CT=4).

Let's now assume that the timer turned on in Step (e) is brought into a time-up state at the time that the note numbers 36, 40, 43, 45 are recorded in the memory regions indicative of the addresses 0, 1, 2, 3, respectively, in the working area in the above-described manner. The timer is used to make a judgment that information-on-depressed-key received during a predetermined period of time from the time required to change CT from CT=0 to CT=1, to the time required to bring the timer into the time-up state, is the information about simultaneously-depressed keys.

Figure 5:
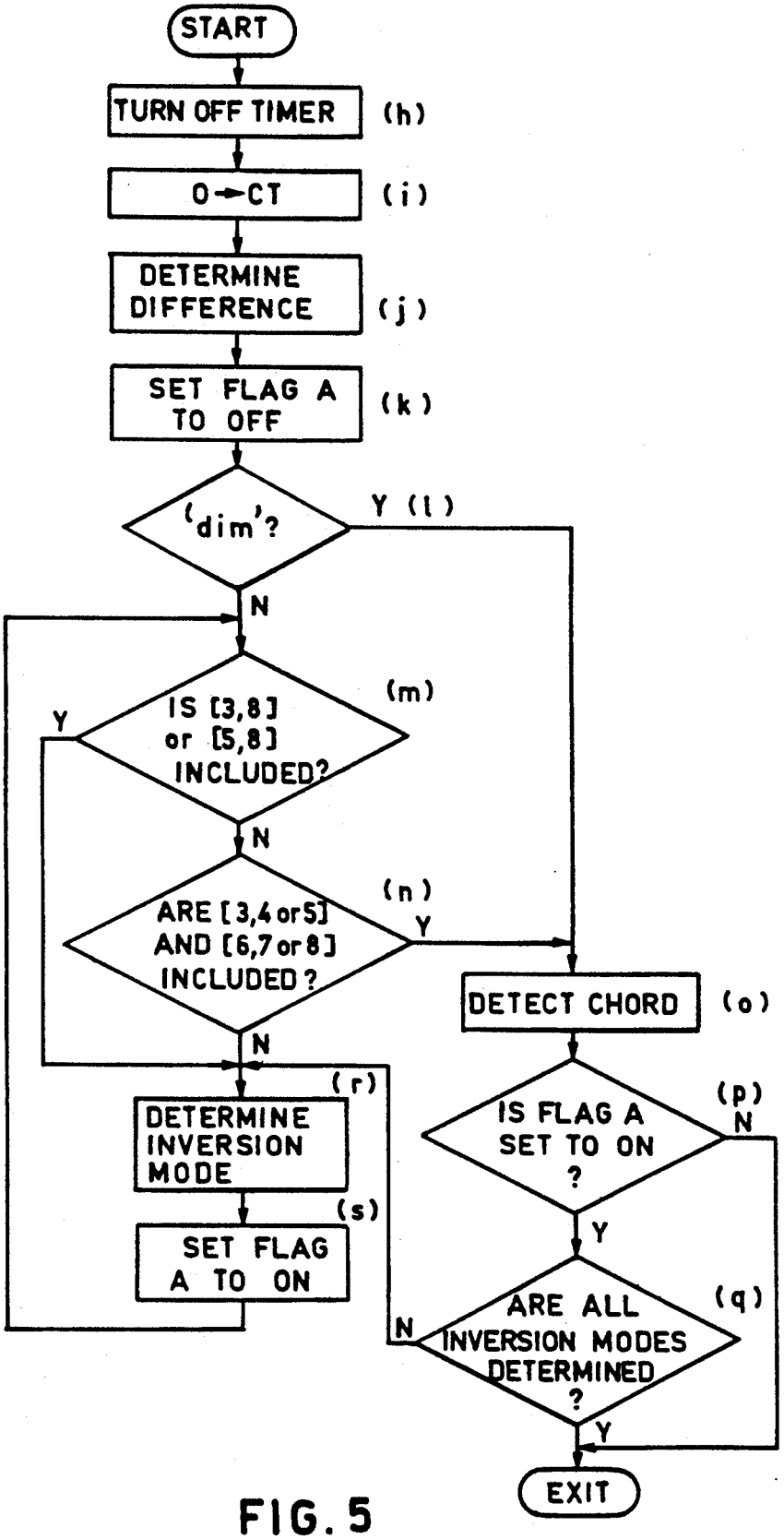
FIG. 5 is a flowchart for describing the procedure of a program executed when a timer, turned on while the program shown in FIG. 3 being executed, is brought into a time-up state.

FIG. 5 is a flowchart for describing the procedure of a program executed at the time that the timer is brought into the time-up state.

When the timer, turned on in Step (e) of the flowchart shown in FIG. 3, is brought into the time-up state, the program shown in FIG. 5 is executed. As a consequence, the timer turned on in Step (e) in FIG. 3 is first turned off, so that it is returned to its initial state again which permits counting of the time (Step (h)). Then, the value of CT is reset to zero (Step (i)). Thereafter, the difference between the value of each note number stored as data in the working area shown in FIG. 4 and the value (36 in the present embodiment) indicative of the lowest sound stored as data at the address of CT=0 is determined. Each difference between the two obtained in Step (j) is determined as [0, 4, 7, 9].

Next, a flag A used for a desired purpose, which will be described later, is initialized (Step (k)).

FIG. 6 is a diagram showing a part of a correspondence table for describing the relationship between each pattern indicative of each difference obtained in Step (j) and each chordal type, the table being used in Steps which will be described hereafter.

FIG. 7 is a diagram depicting a part of a weight factor table for determining the weight applied to each code type determined based on the correspondence table shown in FIG. 6. The respective Steps performed after Step (l) in the flowchart shown in FIG. 5 will now be described with reference to FIGS. 6 and 7. Incidentally, it is needless to say that FIGS. 6 and 7 simply show parts of the tables respectively and it is considered that there are further different types of difference patterns.

Each difference pattern between the two obtained in Step (j) has already been determined as [0, 4, 7, 9]. It is then determined whether or not each pattern referred to above corresponds to any of patterns of a diminished chord (dim) shown in the correspondence table of FIG. 6 (Step (l)). In Step (l), each pattern referred to above does not correspond to any of the patterns of the diminished chord. Therefore, it is determined whether or not [3, 8] or [5, 8] is included in the pattern [0, 4, 7, 9] (Step (m)). However, this condition is not met either, and hence the routine procedure proceeds to the following Step (n). It is determined in Step (n) whether or not the difference pattern mentioned above is a pattern capable of determining a chord. Consequently, it is determined that it is a pattern capable of determining the chord where it includes any one of [3, 4, 5] and any one of [6, 7, 8]. When the condition mentioned above is not met, it is judged that it is a pattern incapable of determining the chord. Since [4, 7] is included in the difference pattern [0, 4, 7, 9] here, it is judged that it is the pattern capable of determining the chord, and hence the routine procedure is advanced to Step (o). Then, the correspondence table shown in FIG. 6 is referred to in Step (o). As a consequence, it is judged to be a major (maj) chord because [0, 4, 7] is included in the difference pattern [0, 4, 7, 9] and to be a sixth (6th) chord because it includes [0, 9]. Further, since the root is C, the chordal name is determined as C(maj)6. In this case, since the flag A is in an OFF state in Step (p), the routine procedure is terminated when the chordal name C(maj)6 is determined, and the chord corresponding to the chordal name is determined as C(maj)6.

A description will next be made of other examples.

Let's now assume that keys corresponding to the musical scales of E, G, A, C are depressed starting from low-numbered order with respect to a plurality of keys on the keyboard shown in FIG. 2, and the difference pattern obtained at the time that the routine procedure has proceeded till Step (l) is [0, 3, 5, 8] in the same manner as described above. In this case, [3, 8] and [5, 8] are included in the pattern [0, 3, 5, 8] in Step (m), and hence the routine procedure is advanced to Step (r).

Paying attention to the difference pattern [0, 3, 5, 8], a first revolution or inversion mode [0, 2, 5, 9] relative to the pattern [0, 3, 5, 8] is determined in Step (r). Then, the flag A indicative of determination of the inversion mode is set to an ON state (Step (s)), and the routine procedure is returned to Step (m) again. Since [3, 8] or [5, 8] is not included in the first inversion mode [0, 2, 5, 9], the routine procedure does not proceed to Step (r) immediately after completion of Step (m). However, the condition represented in Step (n) is not met after referring to the correspondence table shown in FIG. 6. Thus, it is judged that the first inversion mode [0, 2, 5, 9] cannot provide the intended chord. Consequently, the routine procedure is returned to Step (r) again. Then, a second inversion mode [0, 3, 7, 10] is determined in Step (r), and thereafter the routine procedure is returned to Step (m), followed by proceeding to Step (n). Since [3, 7] is included in the second inversion mode [0, 3, 7, 10], the condition in Step (n) is met. Thus, the routine procedure advances to Step (o). Then, the correspondence table shown in FIG. 6 is referred to in Step (o). With this reference, [0, 3] is included in the second inversion mode [0, 3, 7, 10], and hence a minor (min) chord is determined. Further, since [0, 10] exists in the second inversion mode [0, 3, 7, 10], a seventh (7th) chord is determined. Then, the weight is determined in accordance with the following equation, i.e., 12(min) +10(7th) by making use of the weight factors shown in FIG. 7. As a result, the weight is obtained as 22, and the chord is represented by Amin7 since the lowest sound is A.

It is then judged that the flag A has been set to the ON state in Step (p). In Step (q), it is judged whether or not the full inversion modes are determined. Since a third inversion mode is still present in Step (q), the routine procedure proceeds to Step (r) to determine the third inversion mode [0, 4, 7, 9]. Thereafter, the routine procedure is returned to Step (m) again, followed by Step (n). Since [4, 7] is included in the third inversion mode [0, 4, 7, 9], the condition in Step (n) is satisfied, and thereafter the routine procedure proceeds to Step (o). Since the bit pattern [0, 4, 7] exists in Step (o), it is judged to be a major (maj) chord (weight factor is 13). Also since the bit pattern [0, 9] exists, it is judged to be a sixth (6th) chord (weight factor is 3). As a consequence, the weight of the maj6 is determined as 13+3=16. Since the weight of the Amaj7 obtained with respect to the second inversion mode is greater than that of the maj6, the chord Amaj7 is determined as a chord corresponding to the bit pattern shown in FIG. 6.

After the weight of the third inversion mode [0, 4, 7, 9] has been determined in Step (o), the routine procedure is all completed with respect to the full inversion modes and hence the flow of each routine shown in FIG. 5 is terminated.

As described above, the chord, which satisfies a performer's desire as much as practicable, can be obtained by determining the full inversion modes when the intended chord cannot be defined unequivocally, detecting a chord corresponding to each of the thus-determined full inversion modes so as to add the weight to the so-detected chord, and then utilizing a chord with the maximum weight applied thereon as one corresponding to a pattern obtained by depressing a key.

A description will now be made of a method of determining an accompaniment pattern corresponding to the chord, after the chord has been determined in the above-described manner.

FIG. 8 is a diagram showing a part of a priority-level table in which the order of the priority is determined for every chordal type, which chord is produced one by one in association with each of patterns of musical performances such as rock, jazz, classics, etc.

The priority level is given by numbers for every type of chords such as a major (maj) chord, a minor (min) chord, a seventh (7th) chord, etc., which are vertically arranged at the leftmost side of the table. For example, the priority level of the minor (min) is given in the high order of its priority, for example, in the order of min., maj., min7th, 7th, maj7. In addition, information about accompaniment patterns (min., and 7th in the present embodiment) corresponding to the types of chords with numbers enclosed with circles in the table is stored in an unillustrated memory, in addition to this table. The accompaniment patterns and the priority level in the priority-level table shown in FIG. 8 can be rewritten or updated by operating an input board (not shown) provided on a panel of the automatic accompaniment-playing apparatus 2 shown in FIG. 8 by the musical performer.

Each chordal type identical to that vertically arranged at the leftmost side of the table is given the highest priority at all times. Let's now assume that the chord thus determined is minor (min). In this case, the information about the accompaniment pattern for the minor has already been stored in the memory (the number 1 in the priority-level table shown in FIG. 8 is enclosed with the circle). Therefore, the information about it for the minor is read from the memory so as to be transposed based on the root. Thereafter, an accompaniment based on the accompaniment pattern is radiated from the sound system 3 shown in FIG. 1.

Let's also assume that the chord thus determined is major (maj). In this case, information about an accompaniment pattern for the major is not stored in the memory, and the information about the accompaniment patterns for the minor (min) and the seventh (7th) has only been stored therein. Therefore, the information about the accompaniment pattern for the minor (min), which is given a higher priority, out of the two pieces of information about the two accompaniment patterns, is read, and the information about its accompaniment pattern thus read is changed to that for the major (maj) so as to be radiated as a sound into the air. The change from the accompaniment pattern for the minor to that for the major is made by altering a sound of a minor third included in the accompaniment pattern for the minor to that of a major third.

Let's further assume that the chord thus determined is minor seventh (min7th) as a specific example. In this case, information about an accompaniment pattern for the minor seventh (min7th) based on the priority-level table shown in FIG. 8 is not stored in the memory. Since the information about the accompaniment pattern corresponding to the minor (min) and the seventh (7th) is only stored therein, information about an accompaniment pattern for the seventh (7th) given a higher priority as compared with this case is read. Then, the information about the accompaniment pattern for the seventh (7th) thus read is set so as to be suited to the minor seventh (min7th) to thereby flat a sound third in the accompaniment pattern for the seventh (7th) so as to be radiated into the air.

The information about the accompaniment for the seventh (7th) is not stored in the memory in a case where the chord referred to above is the minor seventh (min7th). Therefore, if information about the accompaniment pattern for the minor (min) given a priority immediately after the present priority is read from the memory, a root in the accompaniment pattern for the minor (min) thus read as information is reduced through a whole tone, thereby making it possible to change the same to the accompaniment pattern for the seventh (7th). In general, the accompaniment includes rhythm, a bass and an accompaniment part other than those. However, if the root is varied in the case of a bass part, then the chord becomes improper. Therefore, the root will not be changed in the case of the bass accompaniment.

The information about the accompaniment pattern for the minor (min) as well as for the seventh (7th) is not stored in the memory in the case of the minor seventh (min7th). On the other hand, if the information about the accompaniment pattern for the major (maj), which has been stored in the memory, is read, a root in the accompaniment pattern for the major (maj) as information thus read is lowered through a whole tone, and a sound third is flatted. As a consequence, the accompaniment pattern for the major (maj) is changed to the accompaniment pattern for the minor seventh (min7th), thereby radiating the same as a sound into the air.

Incidentally, the above-described embodiment has shown and described a case where accompaniments different from each other are performed according to the performance modes such as rock, jazz, classics, etc. The present invention is not necessarily limited to the case where the different accompaniments are carried out for each performance mode. The present invention can also be applied to a case where accompaniments are effected for every performance sections such as an introduction, an ending, variations, etc. Further, the present invention can also be applied to a case where different accompaniments are performed according to both the performance mode and section. In this case, let's now consider, by way of example, a case where the priority level at the time that the performance mode is rock and the chordal type is a minor seventh (min7th) is set in the order of minor (min), seventh (7th) and major (maj), information about an accompaniment pattern corresponding to the major (maj) is only stored in a memory upon introduction, and information about accompaniment patterns corresponding to the major (maj) and the minor (min) is stored in the memory upon ending. In this case, when a chord indicative of the minor seventh (min7th) is determined in the course of a performance of rock, the information about the accompaniment pattern for the major (maj) is read from the memory in the case where the performance section is an introduction. On the other hand, when it is an ending, the information about the accompaniment pattern for the minor (min) is read from the memory.

Thus, when the priority level is determined for each chordal type and the information about the accompaniment pattern corresponding to the chordal type is not stored in the memory, the information about the accompaniment pattern corresponding to another chordal type is read. Then, the accompaniment pattern as information thus read is changed so as to be radiated into the air. Therefore, the number of the accompaniment patterns to be stored in the memory can be reduced. In addition, it is possible to save the number of memories and labor for inputting the accompaniment patterns as information.

Having now fully described the invention, it will be apparent to those skilled in the art that many changes and modifications can be made without departing from the spirit or scope of the invention as set forth herein.

What is claimed is:

1. An automatic playing apparatus having a chord detecting device comprising:

pitch name generating means for generating pitch names corresponding to musical sounds to be performed;

chord inversion mode arithmetic determining means for arithmetically determining respective chord inversion modes corresponding to chords when a plurality of pitch names corresponding to musical sounds to be performed are defined as chords;

chord determining means for determining chords corresponding to said inversion modes, respectively;

level weighting arithmetic means for arithmetically determining weighted levels of said chords determined by said chord determining means; and chord detecting means for detecting a maximum level weighted chord out of said weighted chords, as a chord corresponding to each of said plurality of pitch names.

2. An automatic playing apparatus having the chord detecting device as claimed in claim 1, wherein said level weighting arithmetic means determines the weights for every element indicative of the types of chords determined by said chord determining means to add the thus-determined weights together, thereby obtaining the weight applied to said chords from addition of said weights together.

3. An automatic accompaniment-playing apparatus comprising:

chord detecting means for detecting a chord comprised of a plurality of pitch names based on a plurality of pitches corresponding to musical tones to be performed;

accompaniment pattern storing means for storing therein an accompaniment pattern corresponding to a type of at least one chord;

priority-level storing means for storing therein information about a priority level of types of chords for each chordal type; and accompaniment pattern changing means for reading an accompaniment pattern corresponding to the type of a chord detected by the chord detecting means, which is given the highest priority, out of types of chords corresponding to accompaniment patterns stored as information in said accompaniment pattern storing means, from said accompaniment pattern storing means when accompaniment patterns corresponding to the chordal types detected by said chord detecting means are not stored in said accompaniment pattern storing means, thereby changing the accompaniment pattern read by the accompaniment pattern changing means so that it is suited to said chord detected by said chord detecting means.

4. The automatic accompaniment-playing apparatus as claimed in claim 3, wherein said accompaniment pattern storing means is used to store therein the accompaniment pattern as information corresponding to the type of at least one chord for each performance mode or for each performance section.

5. The automatic accompaniment-playing apparatus as claimed in claim 3, wherein said priority-level storing means is used to store therein the information about the priority level of the chord types corresponding to the accompaniment patterns stored as information in said accompaniment pattern storing means.

6. The automatic accompaniment-playing apparatus as claimed in claim 3, comprising and further priority-level inputting means for storing said priority-level in said priority level storing means.

* * * * *